US011487229B2

(12) United States Patent
Kanematsu et al.

(10) Patent No.: US 11,487,229 B2
(45) Date of Patent: Nov. 1, 2022

(54) IMAGE FORMING APPARATUS WITH ADDITIONAL EXHAUST PORT

(71) Applicant: KYOCERA Document Solutions Inc., Osaka (JP)

(72) Inventors: Yoshiharu Kanematsu, Osaka (JP); Taisei Hayakawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/682,229

(22) Filed: Feb. 28, 2022

(65) Prior Publication Data

US 2022/0276592 A1 Sep. 1, 2022

(30) Foreign Application Priority Data

Mar. 1, 2021 (JP) ..... JP2021-031764

(51) Int. Cl.
*G03G 15/20* (2006.01)

(52) U.S. Cl.
CPC ..... *G03G 15/2028* (2013.01); *G03G 15/2064* (2013.01)

(58) Field of Classification Search
CPC ..... G03G 15/2028; G03G 21/206; G03G 15/2064; G03G 21/20; G03G 21/203
See application file for complete search history.

(56) References Cited

U.S. PATENT DOCUMENTS

2011/0064449 A1* 3/2011 Shimizu ..... G03G 15/2017 399/92
2016/0320749 A1 11/2016 Komatsuzaki et al.
2021/0003958 A1* 1/2021 Akamatsu ..... G03G 15/6573
2021/0080882 A1* 3/2021 Sone ..... G03G 21/203
2021/0271194 A1* 9/2021 Lee ..... G03G 15/2053

FOREIGN PATENT DOCUMENTS

JP 2009192623 A * 8/2009 ..... G03G 15/2064
JP 2016-206611 A 12/2016

* cited by examiner

*Primary Examiner* — Sevan A Aydin
(74) *Attorney, Agent, or Firm* — IP Business Solutions, LLC

(57) ABSTRACT

An image forming apparatus includes a guide member including a guide surface that guides a sheet to a delivery rotating body, an opposing member opposed to the other face of the sheet, on an opposite side of the guide surface of the guide member, and defining an air passage between the opposing member and the guide member, such that one end portion is located on a side of the outer space, and the other end portion, on an opposite side of the outer space, communicates with a predesignated space on a side of the fixing device in an apparatus main body, and a dam member located downstream of the delivery rotating body in a sheet transport direction, and configured to dam air to be discharged with the sheet by the delivery rotating body, thereby guiding the air to the one end portion of the air passage.

12 Claims, 10 Drawing Sheets

IMAGE FORMING APPARATUS WITH ADDITIONAL EXHAUST PORT

INCORPORATION BY REFERENCE

This application claims priority to Japanese Patent Application No. 2021-031764 filed on Mar. 1, 2021, the entire contents of which are incorporated by reference herein.

BACKGROUND

The present disclosure relates to an image forming apparatus.

Existing image forming apparatuses based on electrophotography generally include a fixing device that fixes a toner image transferred to a sheet, onto the sheet. The fixing device includes a heat roller having a heat source, such as a heater, and a pressure roller that rotates, being pressed against the heat roller. When the sheet, having the toner image transferred thereto, passes a nip region between the heat roller and the pressure roller, the toner image is heated and pressed, thus to be fixed onto the sheet.

In the image forming apparatus configured as above, the fixing device is activated when the image forming operation is executed. As result, moisture contained in the sheet is evaporated by the heat of the heat roller, and water vapor is generated inside the apparatus. A part of the water vapor is cooled by the ambient air, and turns into fine mist (steam). When the steam spouts through the sheet delivery port, the user may misconceive as fuming, which may cause unnecessary trouble.

Accordingly, some structures have been proposed that discharge the water vapor generated inside the apparatus to outside, without passing through the sheet delivery port.

For example, an image forming apparatus has been proposed that includes a guide member for guiding the sheet, located downstream of the fixing device in the sheet transport direction, the guide member having a plurality of holes formed therein. This image forming apparatus also includes a suction fan, and an exhaust port separately formed, to discharge air. In this image forming apparatus, the suction fan is driven while the image forming operation is being executed, and therefore an airflow is generated that encourages the air inside the apparatus to be discharged through the exhaust port. As result, the water vapor generated from the sheet passes through the holes of the guide member, and is carried by the airflow generated inside the apparatus, thus to be discharged through the exhaust port.

SUMMARY

The disclosure proposes further improvement of the foregoing technique.

In an aspect, the disclosure provides an image forming apparatus including a fixing device, a delivery rotating body, a guide member, an opposing member, and a dam member. The fixing device is located inside an apparatus main body, includes a heating rotating body and a pressure rotating body, and is configured to fix a toner image on a sheet, by causing the sheet to pass through a nip region defined between the rotating bodies. The delivery rotating body delivers the sheet that has undergone a fixing process by the fixing device, to an outer space on an upper side of the apparatus main body, through a sheet delivery port formed in the apparatus main body. The guide member includes a guide surface that guides the sheet to the delivery rotating body, the guide surface being located so as to oppose the delivery rotating body and one face of the sheet discharged from the fixing device. The opposing member is located so as to oppose the other face of the sheet, and on an opposite side of the guide surface of the guide member, and defines an air passage between the opposing member and the guide member, such that one end portion is located on a side of the outer space, and the other end portion, on an opposite side of the outer space, communicates with a predesignated space on a side of the fixing device in the apparatus main body. The dam member is located on an end portion of the outer space of the opposing member, at a position downstream of the delivery rotating body in a sheet transport direction, and dams air about to be discharged together with the sheet by the delivery rotating body, thereby guiding the air into the air passage, from the one end portion of the air passage. A portion of a wall of the apparatus main body adjacent to the predesignated space includes an exhaust port that allows air inside the predesignated space to be discharged to outside.

DETAILED DESCRIPTION

Hereafter, an embodiment of the disclosure will be described, with reference to the drawings. However, the disclosure is not limited to the following embodiment.

[Image Forming Apparatus]

Figure 1:
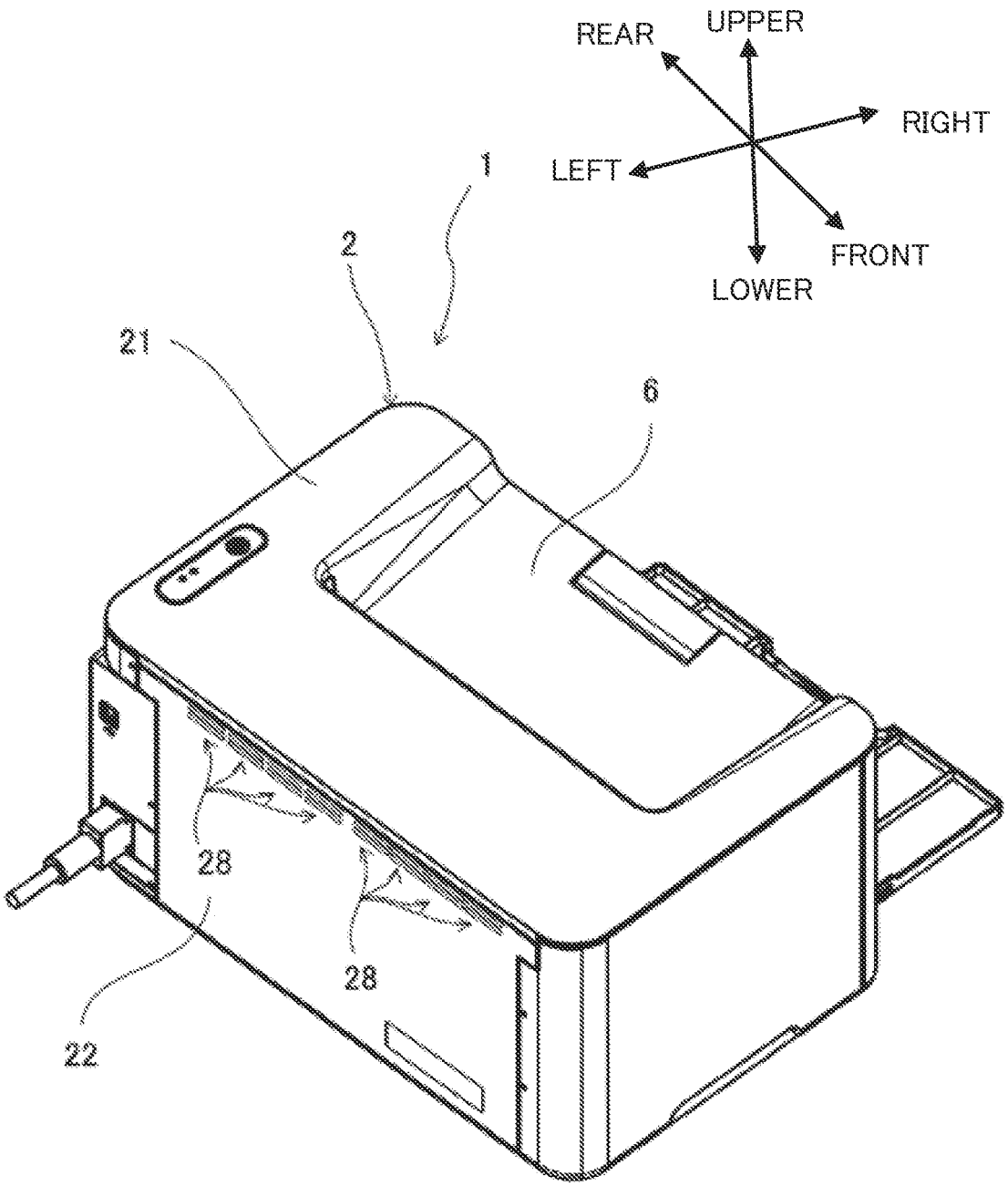
FIG. 1 is a perspective view showing the appearance of an image forming apparatus according to an embodiment.
Figure 2:
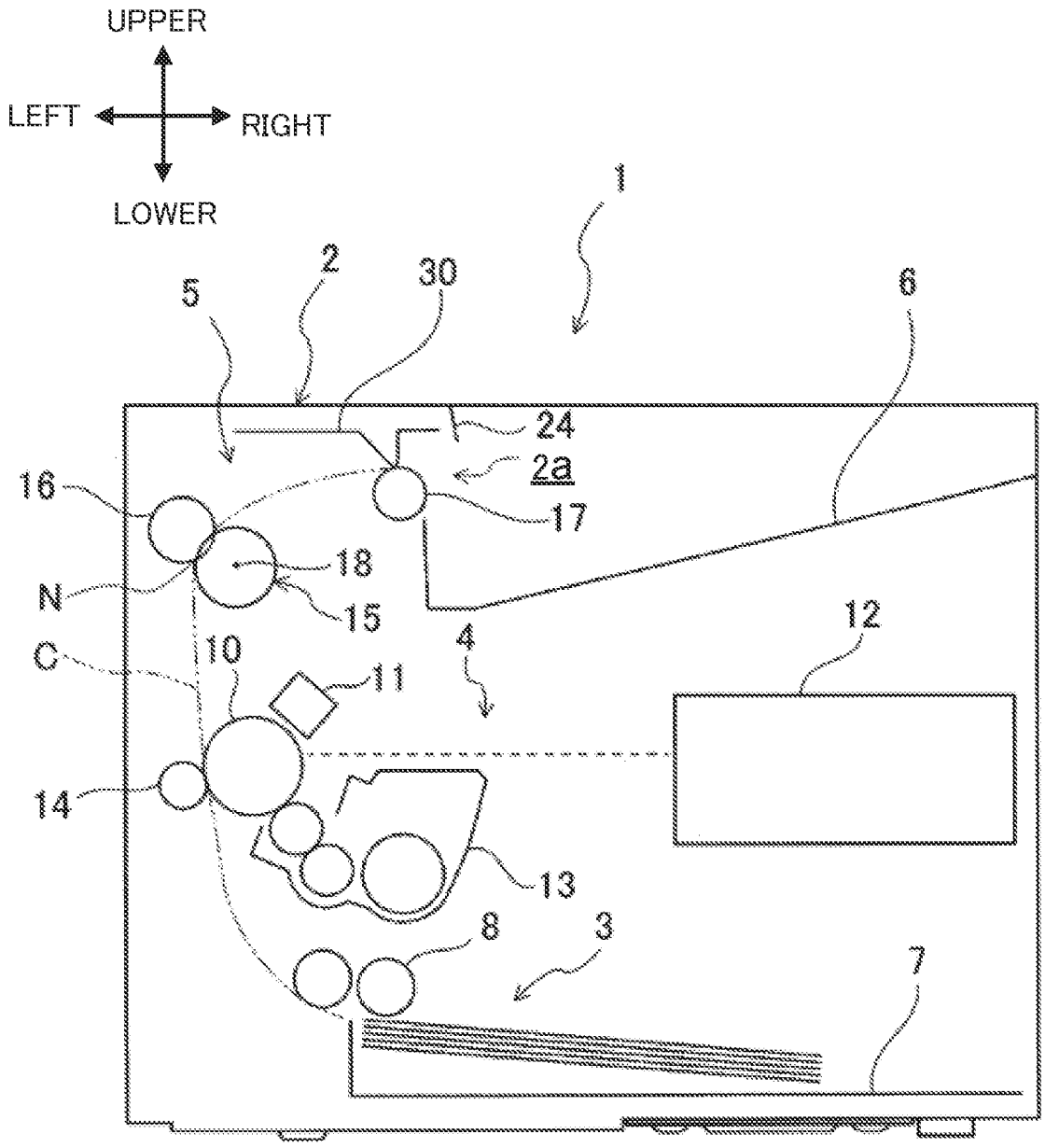
FIG. 2 is a schematic cross-sectional view showing an internal configuration of the image forming apparatus.

FIG. 1 is a perspective view showing the appearance of an image forming apparatus 1. FIG. 2 is a schematic cross-sectional view showing an internal configuration of the image forming apparatus 1. In the following description, the terms "front side" and "rear side" respectively refer to the front side and the rear side of the image forming apparatus 1 (near side and far side in the perpendicular direction of the sheet face of FIG. 2), and the terms "left side" and "right side" respectively refer to the left side and the right side of the image forming apparatus 1, viewed from the front side.

The image forming apparatus 1 is, for example, configured as a monochrome laser printer. The image forming apparatus 1 includes an apparatus main body 2, a paper feeding device 3, an image forming device 4, a fixing device 5, and an output tray 6. The apparatus main body 2 accommodates therein various components necessary for operating the image forming apparatus 1, such as an operation panel and a control circuit board. The side faces of the apparatus main body 2 are each covered with an outer cover made of a resin. In FIG. 1, an upper outer cover 21 and a left outer cover 22 are shown. The upper outer cover 21 includes the output tray 6, and the left outer cover 22 includes exhaust ports 28 to be subsequently described.

The image forming apparatus 1 is configured to form an image on a sheet on the basis of image data, for example transmitted from a non-illustrated terminal device, while transporting the sheet along a sheet transport route C inside the apparatus main body 2.

The paper feeding device 3 is located at the bottom portion of the apparatus main body 2. The paper feeding device 3 includes a paper cassette 7 for accommodating a plurality of sheets stacked on each other, and a pickup roller 8 that draws out the sheets in the paper cassette 7 one by one.

The image forming device 4 is located inside the apparatus main body 2, at a position above the paper feeding device 3. The image forming device 4 includes a photoconductor drum 10, acting as an image carrier rotatably installed in the apparatus main body 2, a charging device 11, a developing device 13, and a transfer roller 14 located around the photoconductor drum 10, and an optical scanning device 12 located on the right of the photoconductor drum 10. Thus, the image forming device 4 is configured to form an image on the sheet delivered from the paper feeding device 3.

The fixing device 5 serves to fix a toner image formed on the sheet by the image forming device 4, onto the sheet. The fixing device 5 is located on the upper side of the photoconductor drum 10 of the image forming device 4. The fixing device 5 includes a heat roller 15 and a pressure roller 16, set to rotate pressed against each other. The heat roller 15 is heated by a halogen heater 18 (see FIG. 3 to be subsequently referred to) provided thereinside. Between the heat roller 15 and the pressure roller 16, a nip region N is defined through which the sheet delivered from the image forming device 4 is to pass. The heat roller 15 corresponds to the heating rotating body in the disclosure, and the pressure roller 16 corresponds to the pressure rotating body in the disclosure. However, the heating rotating body is not limited to the heat roller 15 but may be, for example, a fixing belt or the like.

The output tray 6 corresponds to a recess formed on the right portion of the upper face of the apparatus main body 2. The output tray 6 is inclined upward, toward the downstream side in the sheet transport direction.

The image forming apparatus 1 performs the image forming operation as follows. When the image forming apparatus 1 receives the image data, the photoconductor drum 10 in the image forming device 4 is driven to rotate, and the charging device 11 electrically charges the surface of the photoconductor drum 10.

Then the optical scanning device 12 emits a laser beam to the photoconductor drum 10, according to the image data. Because of the irradiation of the laser beam, an electrostatic latent image is formed on the surface of the photoconductor drum 10. The electrostatic latent image formed on the photoconductor drum 10 is developed by the developing device 13 into a toner image, which is a visible image.

Thereafter, the sheet passes through between the transfer roller 14 and the photoconductor drum 10. During this process, a transfer bias is applied to the transfer roller 14, so that the toner image on the surface of the photoconductor drum 10 migrates to the sheet thus to be transferred thereto. The sheet having the toner image transferred thereto is heated and pressed while passing through the nip region N between the heat roller 15 and the pressure roller 16 in the fixing device 5. As result, the toner image is fixed onto the sheet.

The sheet, on which the toner image has been fixed by the fixing device 5, is delivered to the downstream side in the sheet transport direction, by the rotation of the heat roller 15 and the pressure roller 16, and delivered by a delivery roller 17 (exemplifying the delivery rotating body in the disclosure) to the output tray 6, through a sheet delivery port 2*a*. Here, the delivery roller 17 may deliver the sheet in the horizontal direction, or in a direction inclined upward or downward with respect to the horizontal direction, by a predetermined small angle. Preferably, the predetermined small angle is, for example, 0° to 10°, both ends inclusive.

[Cross-Sectional Configuration from Fixing Device to Delivery Roller]

Figure 3:
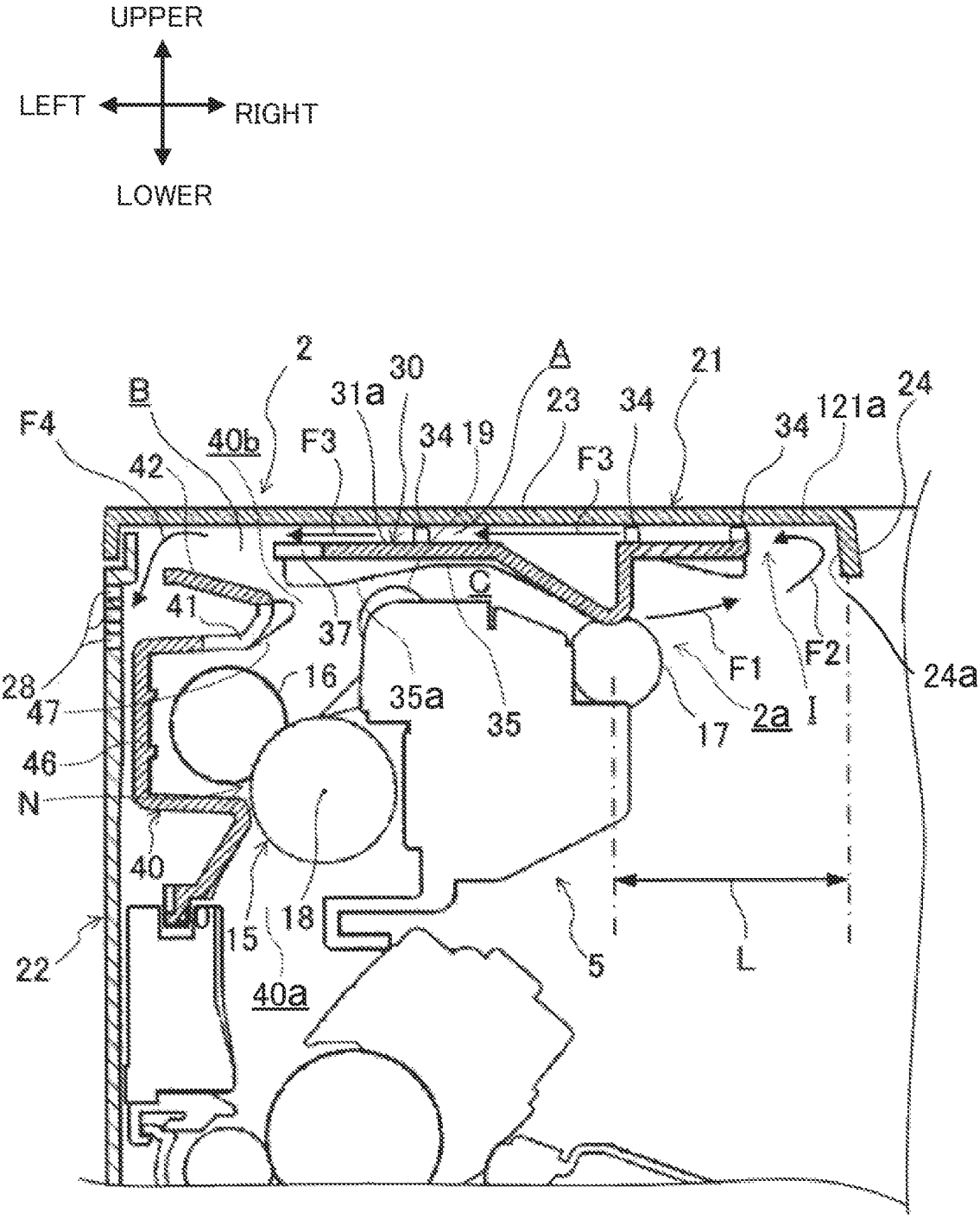
FIG. 3 is an enlarged cross-sectional view showing a part from a fixing device to a delivery roller pair.

FIG. 3 is an enlarged cross-sectional view showing the part from the fixing device 2 to the delivery roller 17, in the apparatus main body 2.

The fixing device 5 includes a fixing device housing 40, in addition to the heat roller 15 and the pressure roller 16. The heat roller 15 and the pressure roller 16 are accommodated inside the fixing device housing 40, with the respective axial lines extending in the forward-rear direction. The fixing device housing 40 is formed as a hollow box, having a generally rectangular parallelepiped shape elongate in the forward-rear direction.

The fixing device housing 40 is located under a predesignated space B, extending in the forward-rear direction along the corner portion defined by the left outer cover 22 and the upper outer cover 21. The fixing device housing 40 is located with a narrow gap from the upper end portion of the inner wall of the left outer cover 22. In the upper end portion of the left outer cover 22, a plurality of exhaust ports 28 are formed, so as to communicate with the predesignated space B. As shown in FIG. 1, the plurality of exhaust ports 28 include a forward-side exhaust port group and a rear-side exhaust port group, each of which includes four pairs of exhaust ports 28, aligned in the forward-rear direction.

On the lower side of the fixing device housing 40, a sheet inlet 40*a* is provided, through which the sheet proceeding to the nip region N from the image forming device 4 is introduced. On the upper side of the fixing device housing 40, sheet outlet 40*b* is provided, through which the sheet that has passed through the nip region N is delivered to the downstream side in the sheet transport direction.

Figure 4:
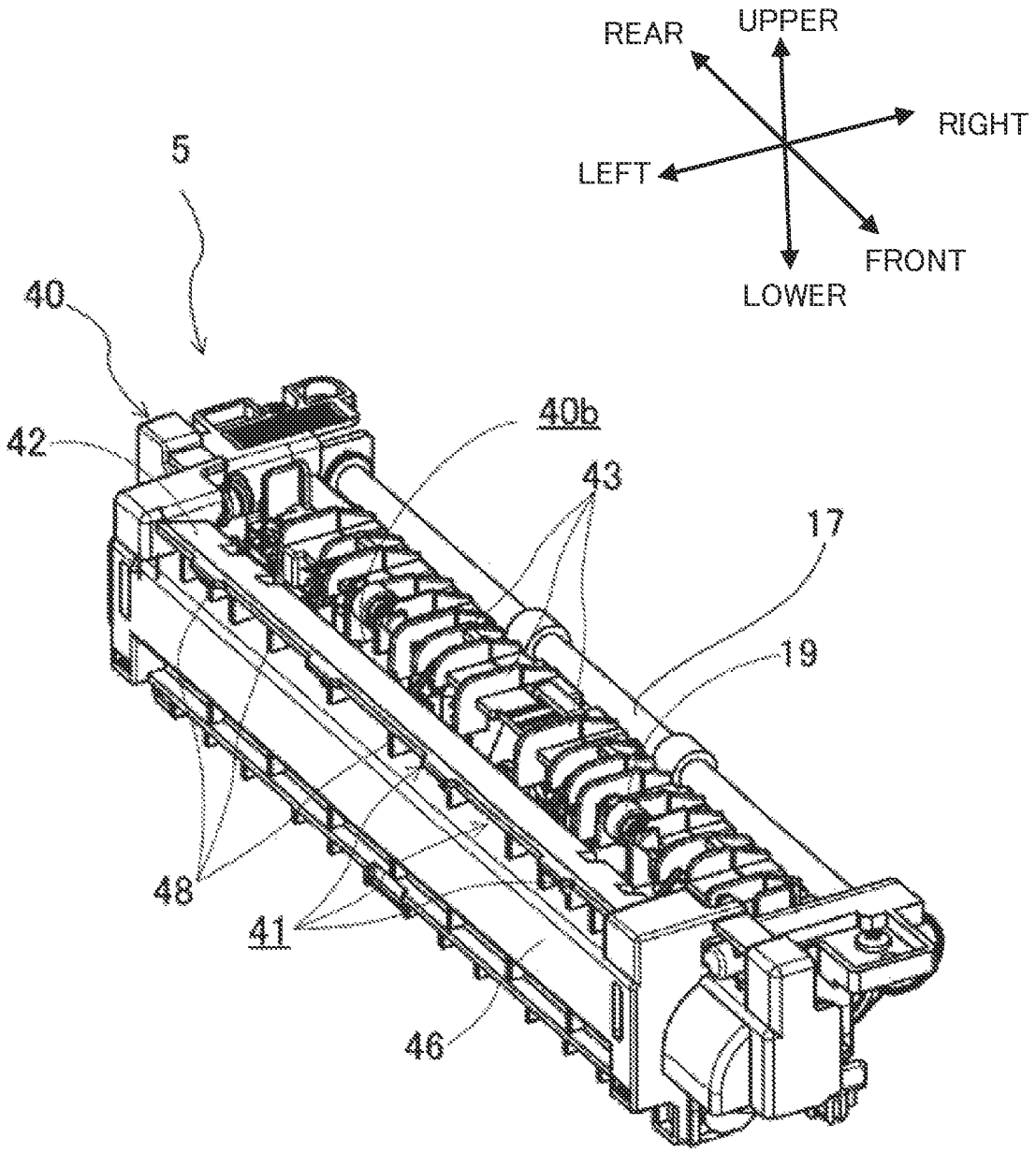
FIG. 4 is a perspective view showing the fixing device.

As shown in FIG. 3 and FIG. 4, on the right-side edge of the sheet outlet 40*b*, located on the upper face of the fixing device housing 40, a pair of guide rollers 19 are rotatably mounted, with an interval therebetween in the forward-rear direction. In addition, on the right end portion of the upper face of the fixing device housing 40, a delivery roller 17 is rotatably supported. Here, the delivery roller 17 may be supported by a supporting wall formed inside the casing.

Between the guide rollers 19 and the delivery roller 17 on the upper face of the fixing device housing 40, a plurality of guide ribs 43 are formed so as to protrude upward, and aligned in the forward-rear direction with an interval between each other, such that the upper end face of each of the guide ribs 43 serves to guide the lower face of the sheet. The upper face of the sheet is guided by a delivery guide 30 (exemplifying the guide member in the disclosure), to be subsequently described.

The fixing device housing 40 includes a sloped plate 42 formed along the left-side edge of the sheet outlet 40*b*, and slightly inclined upward toward the left side, with respect to the horizontal direction. The sloped plate 42 is sticking out into a predesignated space B, extending in the forward-rear direction along the upper left corner portion of the apparatus main body 2.

As shown in FIG. 3, an enclosing wall 46 having a C-shaped cross-section open toward the right side, and surrounding the left side and the upper and lower sides of the pressure roller 16, is formed under the sloped plate 42. The upper wall of the enclosing wall 46 and the sloped plate 42 are continuous with each other, via a connecting wall 47. The upper wall and the sloped plate 42 are connected to each other via a plurality of ribs 48 (see FIG. 4) aligned in the forward-rear direction with an interval between each other. The connecting wall 47 connecting the upper wall and the sloped plate 42 includes a plurality of openings 41, located between adjacent ones of the ribs 48, and allowing communication between inside and outside of the housing. The plurality of openings 41 are located on the right of the exhaust port 28 formed in the left outer cover 22 of the apparatus main body 2. Further, the plurality of openings 41 are located right above the pressure roller 16.

The delivery guide 30 defines a sheet transport route C, with the upper face of the fixing device housing 40. The downstream end of the sheet transport route C in the sheet transport direction corresponds to the nip position of the delivery roller 17, and thus defines the sheet delivery port 2*a*. The delivery guide 30 is attached to the lower face of the upper outer cover 21. Between the upper outer cover 21 and the delivery guide 30, an air passage A is defined, to guide the air discharged by the delivery roller 17 with the sheet through the sheet delivery port 2*a* toward the fixing device 5. Further, a dam plate 24 (exemplifying the dam member in the disclosure) that blocks the air discharged with the sheet by the delivery roller 17 through the sheet delivery port 2*a*, and guides the air into the air passage A, is formed at the right-side end portion of the upper outer cover 21.

Hereunder, further details of the upper outer cover 21 and the delivery guide 30 will be sequentially described, with reference to the drawings.

[Configuration of Upper Outer Cover]

Figure 5:
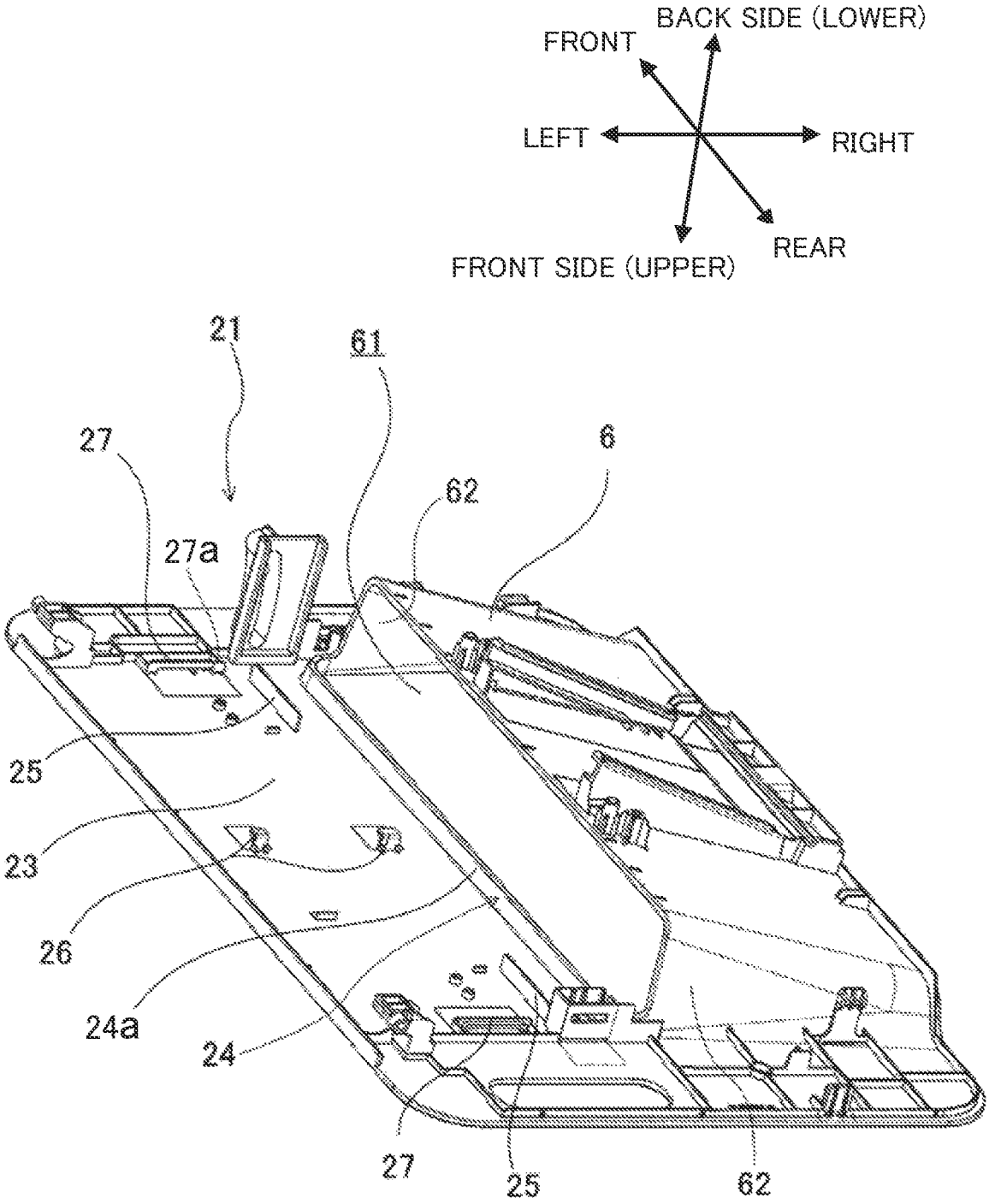
FIG. 5 is a perspective view showing an upper outer cover, seen from the back side.

FIG. 5 is a perspective view showing the upper outer cover 21, seen from the back side (lower side). The upper outer cover 21 is formed of a resin or a metal. The upper outer cover 21 includes a base plate 23, and the output tray 6. The upper outer cover 21 exemplifies the opposing member in the disclosure.

The base plate 23 has a C-shape, when viewed in the up-down direction (front-back direction). In other words, base plate 23 includes a rectangular plate extending in the forward-rear direction so as to constitute the left-side half, and a pair of rectangular plates formed with an interval therebetween in the forward-rear direction, so as to constitute the right-side half. A pair of vertical plates 62, protruding to the back side, are connected to the inner edge of the respective rectangular plates, and the output tray 6 is supported by the base plate 23, via the vertical plates 62. As shown in FIG. 1 and FIG. 5, the output tray 6 is formed in the right-side portion of the base plate 23, so as to recede toward the lower side (back side). An opening 61 for delivering the sheet is formed at the left end of the output tray 6. Here, the opening 61 is covered with a non-illustrated vertical wall extending in the forward-rear direction, such that only the sheet delivery port 2*a* facing the delivery roller 17 is exposed.

As shown in FIG. 2, the output tray 6 is gently inclined upward, in the direction toward the right side.

As shown in FIG. 5, the dam plate 24, a pair of reinforcing ribs 25, a pair of engaging projections 26, and a pair of guide supporters 27 are formed on the back face (lower face) of the base plate 23.

The dam plate 24 is formed in an elongate plate shape, so as to protrude to the back side (lower side) from the back face of the base plate 23. The dam plate 24 extends in the forward-rear direction, in the central portion of the base plate 23 in the left-right direction. The dam plate 24 is located on the left, with respect to the openings 61. In other words, the dam plate 24 is located upstream of the openings 61, in the sheet transport direction.

The left-side face of the dam plate 24 serves as an air damming surface 24*a* that blocks the air. The damming surface 24*a* is inclined to the right side, in the direction toward the lower side. In other words, the dam plate 24 is inclined to the upstream side in the sheet transport direction, in the direction toward the lower side.

As shown in FIG. 5, the pair of reinforcing ribs 25 are formed on the left of the dam plate 24 (upstream side in the sheet transport direction), on the back face (lower face) of the base plate 23. The pair of reinforcing ribs 25 each protrude toward the back side (lower side) from the back face (lower face) of the base plate 23, and are spaced from each other in the forward-rear direction.

The pair of engaging projections 26 are formed on the left of the dam plate 24 (upstream side in the sheet transport direction), on the back face (lower face) of the base plate 23. The engaging projections 26 each protrude in an L-shape toward the back side (lower side), from the back face (lower face) of the base plate 23. The pair of engaging projections 26 are spaced from each other in the left-right direction.

The guide supporters 27 are located on the left of the respective reinforcing ribs 25 (upstream side in the sheet transport direction), on the back face (lower face) of the base plate 23. In other words, two guide supporters 27 are provided on the back face (lower face) of the base plate 23. The pair of guide supporters 27 are spaced from each other in the forward-rear direction. The guide supporters 27 each have a C-shape when viewed in the forward-rear direction, and include a rectangular mounting hole 27*a* located between the guide supporter 27 and the base plate 23. The delivery guide 30, to be subsequently described, is attached to the upper outer cover 21, via the mounting hole 27*a*.

The base plate 23 of the upper outer cover 21 includes no openings, except for the mounting holes 27*a* necessary for the mounting of the delivery guide 30. Such a configuration ensures the air flowability through the air passage A between the upper outer cover 21 and the delivery guide 30.

[Configuration of Delivery Guide]

Figure 6:
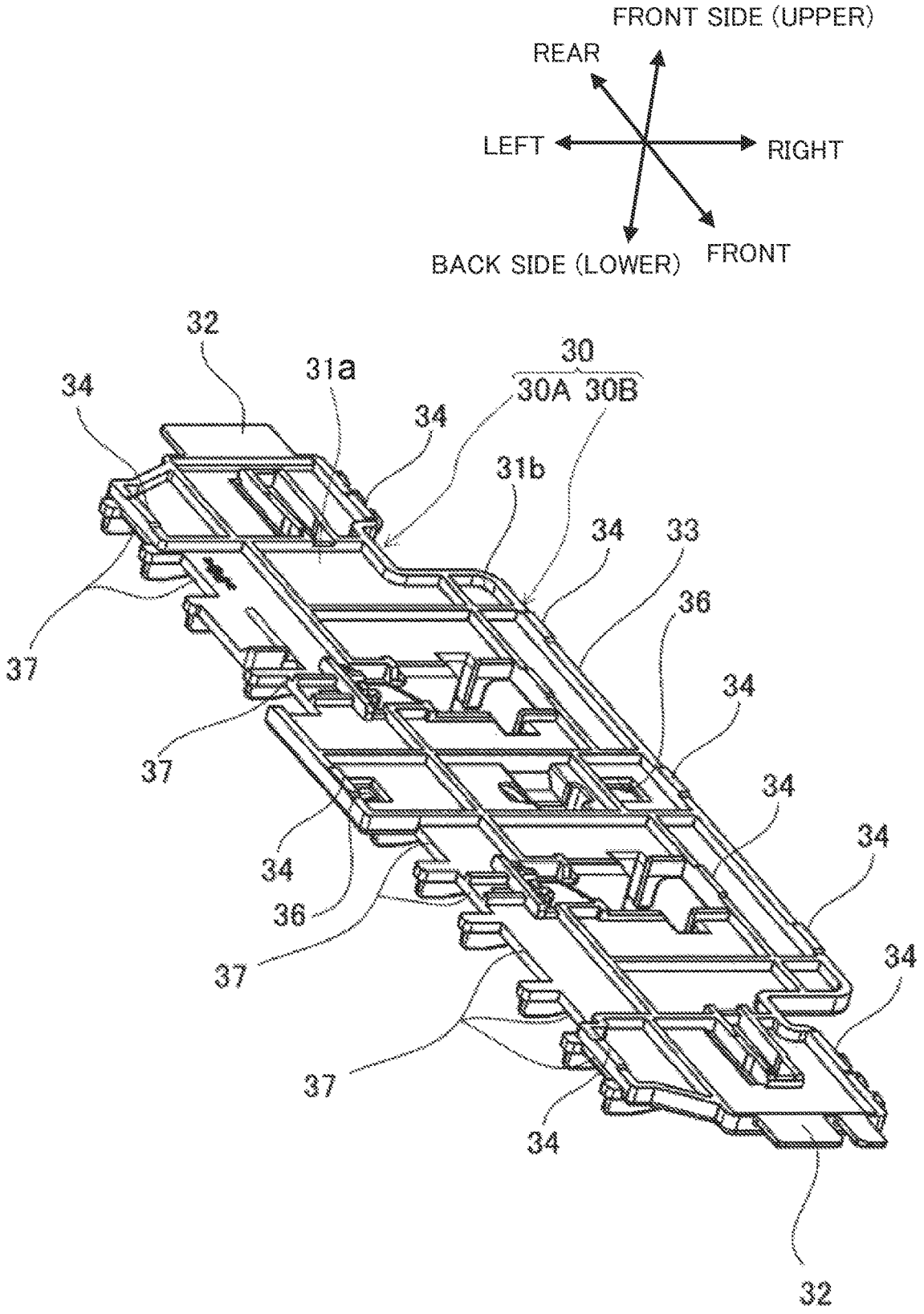
FIG. 6 is a perspective view showing a delivery guide, seen from the front side.
Figure 7:
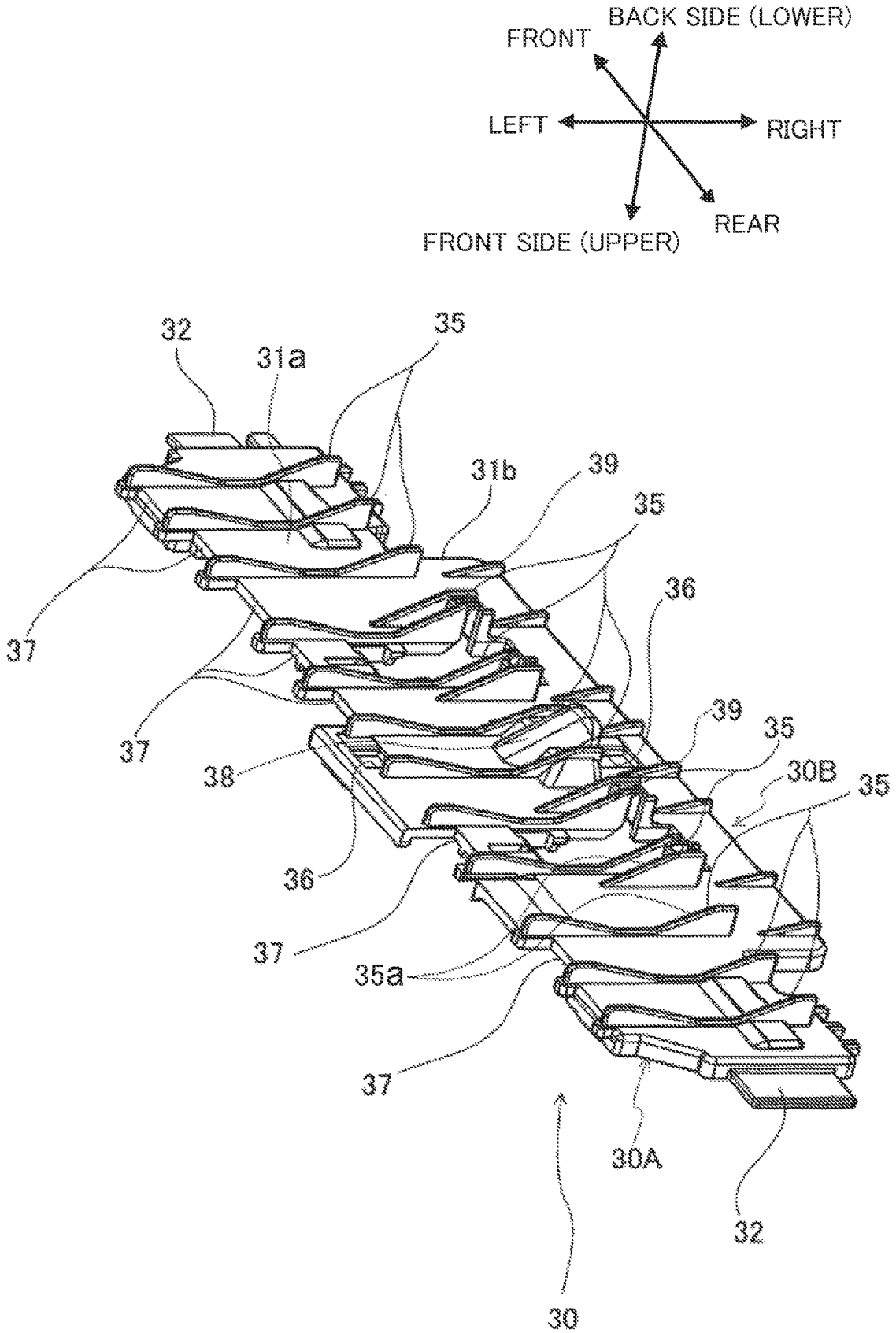
FIG. 7 is a perspective view showing the delivery guide, seen from the back side.

FIG. 6 is a perspective view showing the delivery guide 30 seen from the front side. FIG. 7 is a perspective view showing the delivery guide 30 seen from the back side.

The delivery guide 30 includes a guide main portion 30A having a guide surface 35*a* that guides the sheet on which the toner image has been fixed (sheet that has undergone the fixing process) to the delivery roller 17, and an extended portion 30B connected to the end portion of the guide main portion 30A on the downstream side in the sheet transport direction, and extending to a position downstream of the delivery roller 17 in the sheet transport direction. The delivery guide 30 is an elongate member extending in the forward-rear direction, for example made of a resin or a metal.

To be more detailed, the guide main portion 30A includes a main base plate 31*a*, a pair of mounting plates 32, an upper face rib 33, a plurality of protruding portions 34, a plurality of guide ribs 35 (see FIG. 7), and a plurality of cutaway portions 37. The extended portion 30B includes an extended base plate 31*b* and a plurality of regulating ribs 39.

The main base plate 31*a* and the extended base plate 31*b* (collectively referred to as base plate 31, where appropriate) both have a rectangular plate shape extending in the forward-rear direction.

The main base plate 31*a* and the extended base plate 31*b* each include a mounting hole 36. These mounting holes 36 are located at the center of the delivery guide 30 in the forward-rear direction, and spaced from each other in the left-right direction. The mounting holes 36 are formed so as to penetrate through the main base plate 31*a* and the extended base plate 31*b* respectively, in the up-down direction. The two mounting holes 36 are located at the position corresponding to the respective engaging projections 26 of the upper outer cover 21.

The plurality of cutaway portions 37 are formed along the left edge of the main base plate 31*a*, with an interval between each other in the forward-rear direction. In other words, the plurality of cutaway portions 37 are formed along the edge of the main base plate 31*a* on the upstream side in the sheet transport direction. The plurality of cutaway portions 37 are spaced from each other along the forward-rear direction. The plurality of cutaway portions 37 are each formed so as to penetrate through the left edge of the main base plate 31*a* in the up-down direction, and open toward the left side. Accordingly, the left edge of the main base plate 31*a* is formed in a comb shape, when viewed in the front-back direction.

The mounting plates 32 are formed at the respective end portions of the main base plate 31*a*, in the forward-rear direction. The mounting plates 32 are each formed in a rectangular flat plate shape, and protruding toward the outer side in the forward-rear direction, from the end portion of the main base plate 31*a* in the forward-rear direction.

As shown in FIG. 6, the upper face rib 33 is formed on the upper face (front face) of the main base plate 31*a*, so as to protrude upward from the upper face of the main base plate 31*a*. The upper face rib 33 includes a plurality of ribs extending in the forward-rear direction, and a plurality of ribs extending in the left-right direction.

The plurality of protruding portions 34 are formed on the upper end face of the upper face rib 33. The protruding portions 34 each protrude upward, from the upper end face of the upper face rib 33. In other words, the upper face rib 33 includes the plurality of protruding portions 34 formed on the upper end face thereof. The protruding portion 34 exemplifies the first protruding portion in the disclosure.

As shown in FIG. 7, the plurality of guide ribs 35 are formed on the lower face (back face) of the main base plate 31*a*, so as to protrude downward from the lower face of the main base plate 31*a*. The plurality of guide ribs 35 are vertical ribs of a trapezoidal shape extending in the left-right direction, and aligned along the forward-rear direction with an interval between each other. The protruding end face of each of the guide ribs 35 is formed generally in a V shape when viewed in the forward-rear direction, such that the central portion in the left-right direction is recessed toward the front side, with respect to the end portions. Accordingly, the protruding end face of each of the guide ribs 35 serves as the guide surface 35*a* that guides the sheet toward the delivery roller 17.

The extended base plate 31*b* is continuously connected to the right-side edge of the main base plate 31*a*. The extended base plate 31*b* is formed in a shorter length in the forward-rear direction, compared with the main base plate 31*a*. The plurality of regulating ribs 39 are vertical ribs of a right triangular shape extending in the left-right direction, and aligned along the forward-rear direction with an interval between each other. The protruding end face of each of the regulating ribs 39 is inclined downward in the direction toward the right side, when viewed in the forward-rear direction. The regulating ribs 39 each protrude downward from the lower face of the extended base plate 31*b*. The protruding end face of each of the regulating ribs 39 serves to suppress the sheet delivered through the delivery roller 17 from swelling upward, thereby smoothly guiding the sheet toward the output tray 6.

Here, although the delivery guide 30 includes a plurality of openings, these openings are all utilized to attach the delivery guide 30 to the upper outer cover 21. Therefore, sufficient flowability of air proceeding toward the predesignated space B can be secured, through the air passage A between the delivery guide 30 and the upper outer cover 21.

[Attaching Delivery Guide to Upper Outer Cover]

Figure 8:
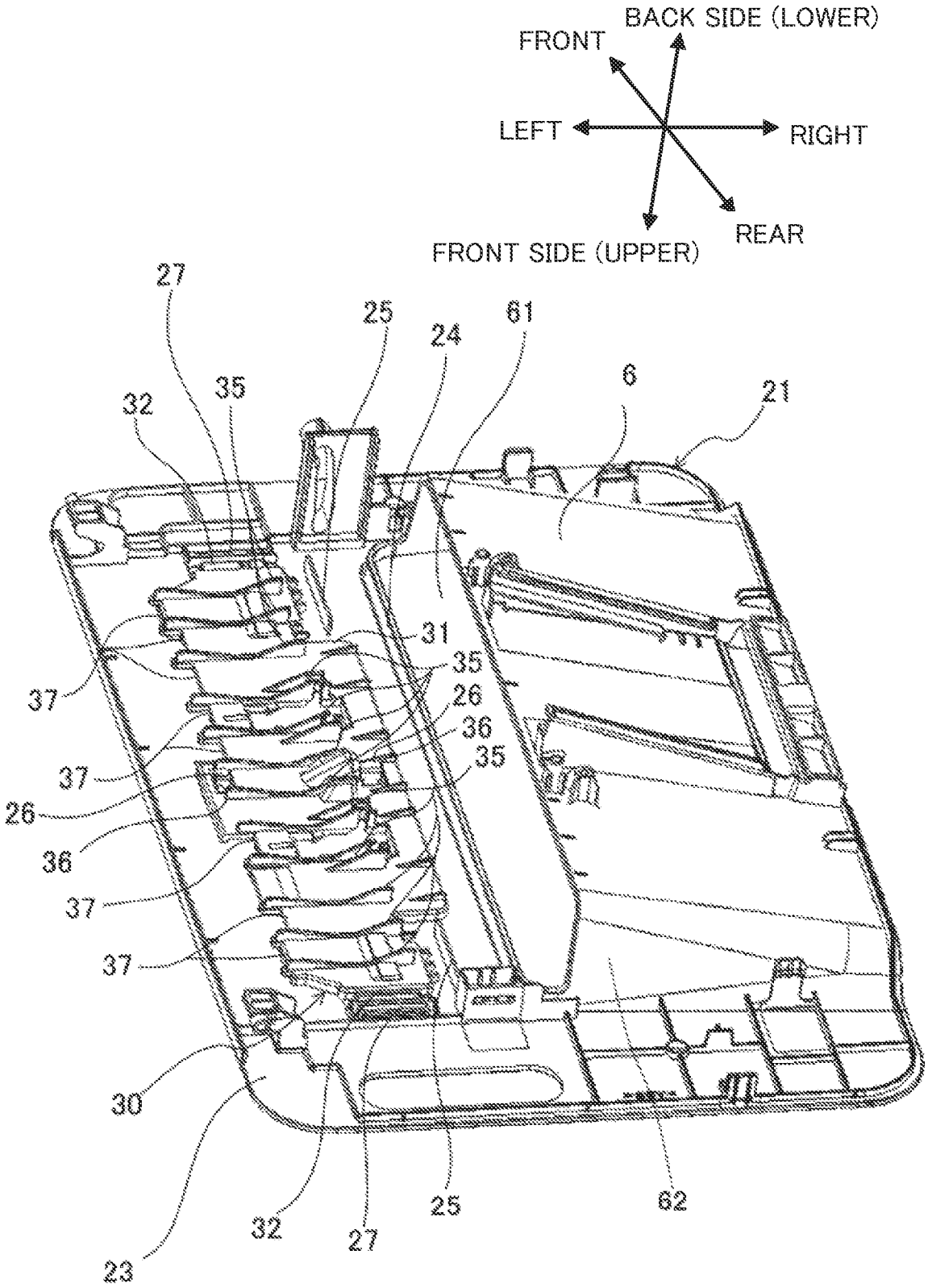
FIG. 8 is a perspective view showing the upper outer cover with the delivery guide attached thereto, seen from the back side.

FIG. 8 is a perspective view showing the upper outer cover 21, with the delivery guide 30 attached thereto, seen from the back side.

To attach the delivery guide 30 to the upper outer cover 21, the front face (upper face) of the delivery guide 30 (see FIG. 6) is opposed to the back face (lower face) of the upper outer cover 21 (see FIG. 5). Then the engaging projections 26 of the upper outer cover 21 are inserted in the respective mounting holes 36 of the delivery guide 30, and the mounting plates 32 of the delivery guide 30 are inserted in the mounting hole 27*a* of the respective guide supporters 27 of the upper outer cover 21.

As result, the engaging projections 26 of the upper outer cover 21 are engaged with the edge of the respective mounting holes 36 on the lower face of the delivery guide 30, and the mounting plates 32 of the delivery guide 30 are supported by the respective guide supporters 27 of the upper outer cover 21. Through such process, the delivery guide 30 can be attached to (supported by) the upper outer cover 21.

When the delivery guide 30 is attached to the upper outer cover 21 as shown in FIG. 3, the protruding portions 34 of the delivery guide 30 are made to abut against the base plate 23 of the upper outer cover 21, and therefore the air passage A is defined between the base plate 23 of the upper outer cover 21 and the base plate 31 of the delivery guide 30.

In the mentioned state, the delivery guide 30 is located on the upper side of the fixing device 5, and a roller sliding portion 38, projecting from the central position of the delivery guide 30 in the forward-rear direction, is made to abut against the delivery roller 17 in the up-down direction. Further, the predesignated space B is defined in the region above the fixing device 5, and on the left of the delivery guide 30.

The air passage A has the left end portion communicating with the predesignated space B, and the right end portion communicating with outer space outside the sheet delivery port 2*a*. Further, the air passage A is formed over the entirety of the sheet transport route C in the forward-rear direction (width direction of the transport route, perpendicular to the sheet face of FIG. 3).

In the assembled state shown in FIG. 3, the upper outer cover 21 includes an overhung portion 121*a* extending to the downstream side in the sheet transport direction, with respect to the delivery guide 30. The overhung portion 121*a* is formed so as to cover the upper side of the delivery route of the sheet delivered by the delivery roller 17.

The dam plate 24 protrudes from the distal end of the overhung portion 121*a* toward the sheet delivery route. The air damming surface 24*a* of the dam plate 24 is inclined to the right (downstream side in the sheet transport direction), in the direction toward the lower side in the vertical direction.

The dam plate 24 is located on the upper side with respect to the delivery roller 17, and on the right thereof (downstream side in the sheet transport direction). Further, the dam plate 24 is located on the right side (downstream side in the sheet delivery direction), with respect to the right end face of the extended portion 30B of the delivery guide 30. Preferably, a distance L in the left-right direction between the dam plate 24 and the delivery roller 17 is 3 mm to 60 mm, and more preferably 20 mm to 35 mm. Between the right end face (downstream-side end face in the sheet transport direction) of the extended portion 30B of the delivery guide 30 and the dam plate 24, air introduction space I, for introducing the air blocked by the dam plate 24 into the air passage A, is defined.

[Airflow in the Apparatus]

When the image forming operation is executed in the image forming apparatus 1, the heat roller 15 generates heat, and therefore the air around the heat roller 15, in other words the air around the fixing device 5 is increased. The air with the increased temperature migrates upward (see FIG. 3). The air with the increased temperature then passes through the sheet outlet 40*b* of the fixing device housing 40, the plurality of openings 41, and the cutaway portions 37 of the delivery guide 30, and gathers in the predesignated space B. Thus, the high-temperature air gathers in the predesignated space B.

In addition, when the sheet transported from the image forming device 4 to the fixing device 5 passes through the nip region N between the heat roller 15 and the pressure roller 16, the moisture contained in the sheet is heated by the heat roller 15, and water vapor is generated. The air containing the water vapor moves together with the sheet along the lower face of the delivery guide 30, as far as the delivery roller 17.

The air containing the water vapor migrates from the delivery roller 17 to the downstream side in the sheet transport direction, and slightly upward, as indicated by an arrow F1 in FIG. 3. Then, as indicated by an arrow F2, the air containing the water vapor hits the dam plate 24 of the upper outer cover 21, and proceeds in the reverse direction (to the upstream side in the sheet transport direction) through the air introduction space I, along the lower face of the overhung portion 121*a* of the upper outer cover 21.

Accordingly, the air containing the water vapor migrates to the left (to the upstream side in the sheet transport direction) through the air passage A between the upper outer cover 21 and the delivery guide 30, as indicated by an arrow F3, and reaches the predesignated space B. As described above, the high-temperature air is present in the predesignated space B. Therefore, the water vapor that has reached the predesignated space B is heated by the high-temperature air. As result, although a part of the water vapor has turned into steam, the steam is again evaporated by being heated. Then the water vapor that has passed through the predesignated space B is discharged to outside, through the exhaust ports 28 of the left outer cover 22, as indicated by an arrow F4.

Advantageous Effects

As described above, the image forming apparatus 1 according to this embodiment includes the upper outer cover 21, opposed to the face of the delivery guide 30 opposite to the guide surface, so as to define the air passage A between the upper outer cover 21 and the opposite face of the delivery guide 30. The air passage A has the right end portion communicating with the outer space outside the sheet delivery port 2*a*, and the left end portion communicating with the predesignated space B on the side of the fixing device 5 inside the apparatus main body 2. The image forming apparatus 1 also includes the dam plate 24, located downstream of the delivery roller 17 in the sheet transport direction, and configured to block the air discharged with the sheet by the delivery roller 17 and guide the air to the opening of the air passage A on the right end portion.

The mentioned configuration allows the water vapor (air containing much moisture), generated from the sheet heated by the fixing device 5 and discharged with the sheet, to flow in the reverse direction toward the air passage A with the dam plate 24, before the water vapor turns into steam. Accordingly, the water vapor generated from the sheet heated by the fixing device 5 can be prevented from being discharged in the form of steam, through the sheet delivery port 2*a*, with a simple structure. In addition, the water vapor flowing in the reverse direction is guided through the air passage A to the predesignated space B, which is a high-temperature space, on the side of the fixing device 5. Since the water vapor is evaporated by being heated in the high-temperature space (i.e., predesignated space B), the water vapor can be securely prevented from turning into steam. Therefore, unlike in the conventional apparatuses, the water vapor can be prevented from residing in the space above the fixing device 5, and turning into water droplets.

In addition, the exhaust ports 28, for discharging the air inside the predesignated space B to outside, are formed in the portion of the wall of the apparatus main body 2 adjacent to the predesignated space B (upper end portion of the left outer cover 22).

When an excessive amount of water vapor gathers in the predesignated space B, the water vapor is prone to turn into steam. However, providing the exhaust ports 28 as above enables the water vapor to be released to outside through the exhaust ports 28, before turning into steam.

According to the foregoing embodiment, the delivery guide 30 includes the guide main portion 30A having the guide surface for guiding the sheet on which the toner image has been fixed (sheet that has undergone the fixing process) to the delivery roller 17, and the extended portion 30B continuously connected to the end portion of the guide main portion 30A on the downstream side in the sheet transport direction, and extending to the downstream side in the sheet transport direction, with respect to the delivery roller 17. The upper outer cover 21 includes the overhung portion 121*a*, extending to the downstream side in the sheet transport direction, with respect to the extended portion 30B of the delivery guide. The dam plate 24 is protrudes from the overhung portion 121*a* toward the sheet delivery route, so as to define the air introduction space I communicating with the air passage A, in the space between the dam plate 24 and the distal end portion of the extended portion 30B of the delivery guide 30.

The mentioned configuration assures that the air discharged with the sheet by the delivery roller 17 is caught in the air introduction space I on the left side of the dam plate 24, and made to flow in the reverse direction.

According to the foregoing embodiment, the delivery roller 17 is configured to deliver the sheet in the horizontal direction, or a direction inclined upward or downward with respect to the horizontal direction by the predetermined small angle, and the overhung portion 121*a* of the upper outer cover 21 is configured so as to cover the sheet delivery route from the upper side, in the region downstream of the delivery roller 17 in the sheet transport direction.

With the mentioned configuration, the air discharged with the sheet by the delivery roller 17, which tends to flow upward because of a difference in temperature from the ambient air, can be securely caught by the overhung portion 121*a*, and guided to the air passage A.

According to the foregoing embodiment, the predesignated space B in the apparatus main body 2 is located adjacent to the sheet outlet 40*b* in the fixing device housing 40, and communicating with the space inside the fixing device housing 40, via the sheet outlet 40*b*.

Therefore, the high-temperature air around the heat roller 15 can be introduced to the predesignated space B through the sheet outlet 40*b* in the fixing device housing 40. In addition, the predesignated space B also serves as the passage for the air containing water vapor. Therefore, even though a part of the water vapor has turned into steam, such steam can be again evaporated by the high-temperature air, before being discharged to outside.

According to the foregoing embodiment, the fixing device housing 40 also includes the openings 41, formed in the portion of the wall of the fixing device housing 40 opposing the exhaust ports 28, thus allowing communication between the inside and outside of the fixing device housing 40.

The mentioned configuration enables the high-temperature air around the heat roller 15 to reach the region in the predesignated space B close to the exhaust ports 28, through the openings 41 of the fixing device housing 40. Therefore, the air about to be discharged to outside through the exhaust ports 28 can be surely heated, and the water vapor can be prevented from turning into steam, immediately before being discharged through the exhaust ports 28.

According to the foregoing embodiment, the delivery guide 30 is mounted such that the end portion on the upstream side in the sheet transport direction is located above the fixing device 5. In addition, the delivery guide 30 includes the plurality of cutaway portions 37 (exemplifying the penetrating portion in the disclosure), aligned in the width direction of the sheet transport along the edge on the upstream side in the sheet transport direction, so as to penetrate through the delivery guide 30 in the up-down direction.

Therefore, the high-temperature air around the heat roller 15 can be collected into the predesignated space B, through the cutaway portions 37. In addition, the predesignated space B also serves as the passage for the water vapor. Therefore, even though a part of the water vapor has turned into steam, such steam can be again evaporated by the high-temperature air, before being discharged to outside.

According to the foregoing embodiment, the delivery guide 30 includes the protruding portions 34, formed on the face thereof opposing the upper outer cover 21, to be made to abut against the upper outer cover 21 thereby securing the air passage A between the delivery guide 30 and the upper outer cover 21.

Therefore, the air passage A can be surely secured between the delivery guide 30 and the upper outer cover 21, by making the protruding portions 34 of the delivery guide 30 abut against the upper outer cover 21, when attaching the delivery guide 30 to the upper outer cover 21. Without the protruding portions 34, the air passage A may be closed because of an external force or thermal deformation. However, providing the protruding portions 34 enables such troubles to be avoided.

According to the foregoing embodiment, the air damming surface 24*a* of the dam plate 24 is inclined toward the downstream side in the sheet transport direction, in the direction toward the lower side from the right end portion of the overhung portion 121*a* of the upper outer cover 21.

The mentioned configuration allows the air blocked by the air damming surface 24 to smoothly turn the flow direction (flow in the reverse direction), thus to be guided to the air passage A.

According to the foregoing embodiment, the upper outer cover 21, constituting a part of the outer wall of the apparatus main body 2, is utilized as the opposing member opposed to the surface of the delivery guide 30 on the opposite side of the guide surface.

Therefore, the number of parts can be reduced, which leads to reduction in cost, compared with the case where the opposing member is separately provided in addition to the upper outer cover 21.

According to the foregoing embodiment, the dam plate 24 is formed integrally with the upper outer cover 21. Such a configuration contributes to reducing the number of parts, thus reducing the cost.

Recently, there has been an increasing demand for cost reduction of the image forming apparatus. As result, the image forming apparatus without a fan has come to be required. In the case where the suction fan is excluded from the image forming apparatus according to the background art, the water vapor generated from the sheet resides inside the apparatus, after passing through the holes of the guide member. When the image forming operation is further continued, a large amount of water vapor resides inside the apparatus, and consequently the water vapor pours out of the sheet delivery port. When a part of such water vapor turns into steam, the user may misconceive the steam as fuming. However, with the configuration according to the foregoing embodiment, the water vapor generated from the sheet heated by the fixing device can be prevented from being discharged from the sheet delivery port in the form of steam.

[Variation 1]

Figure 9:
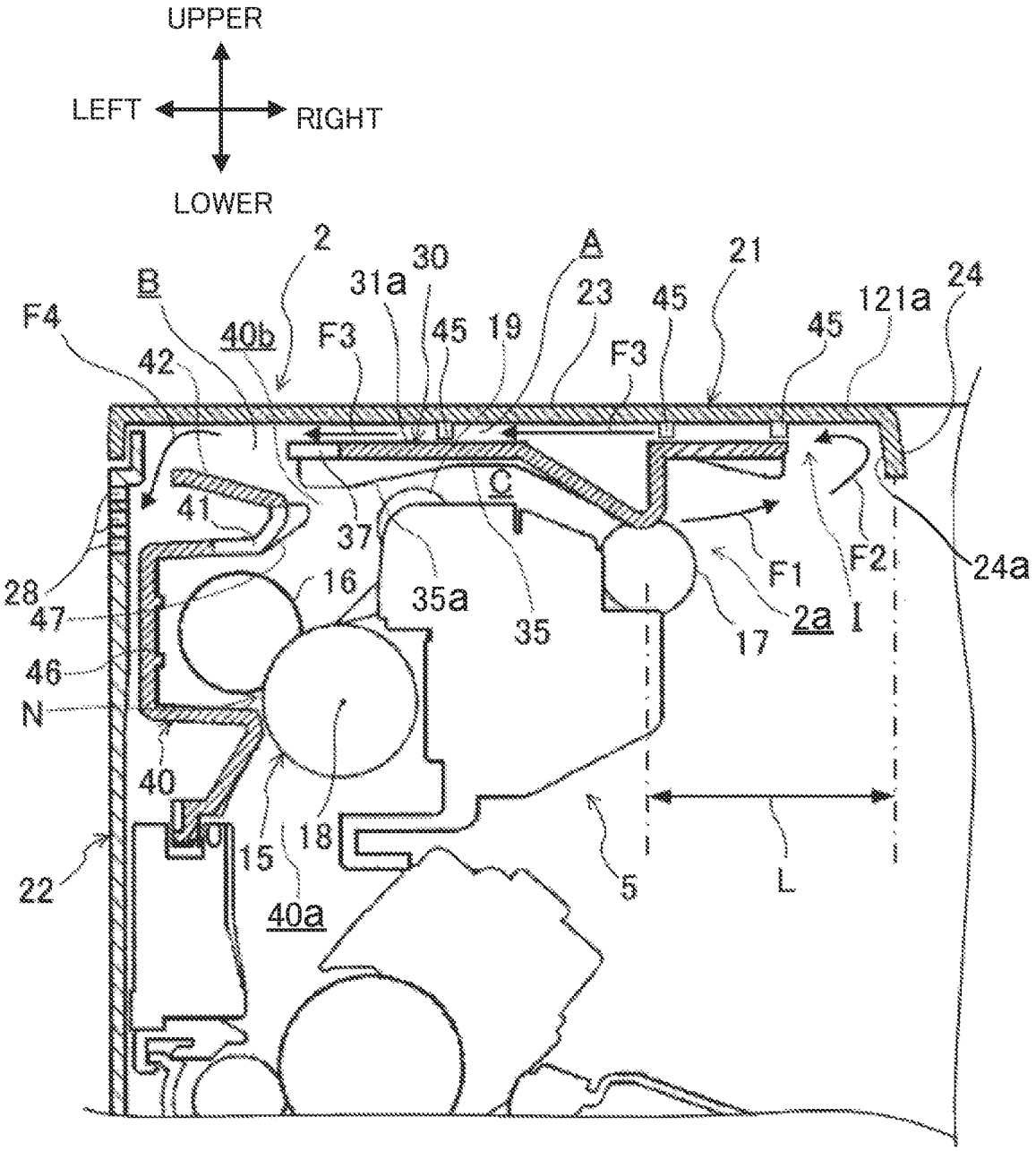
FIG. 9 is a cross-sectional view corresponding to FIG. 3, showing a variation 1.

FIG. 9 illustrates a variation 1 of the embodiment. In this variation, the upper outer cover 21 includes a plurality of protruding portions 45, instead that the delivery guide 30 includes the protruding portions 34. The protruding portion 45 exemplifies the second protruding portion in the disclosure. For the description of the variations, the same elements as those shown in FIG. 3 are given the same numeral, and detailed description thereof will not be repeated.

The plurality of protruding portions 45 are formed on the base plate 23 of the upper outer cover 21. The protruding portions 45 each protrude downward, from the lower face of the base plate 23 (face opposing the delivery guide 30). In other words, the protruding portions 45 protrude toward the delivery guide 30. When the delivery guide 30 is attached to the upper outer cover 21, the base plate 31 of the delivery guide 30 is made to abut against the protruding portions 45 of the upper outer cover 21, so that the air passage A is defined between the base plate 23 of the upper outer cover 21 and the base plate 31 of the delivery guide 30.

With the configuration according to this variation, the air passage A can be surely secured between the upper outer cover 21 and the delivery guide 30 as in the foregoing embodiment, because of the protruding portions 45. Therefore, the same advantageous effects as those provided by the embodiment can be attained.

[Variation 2]

Figure 10:
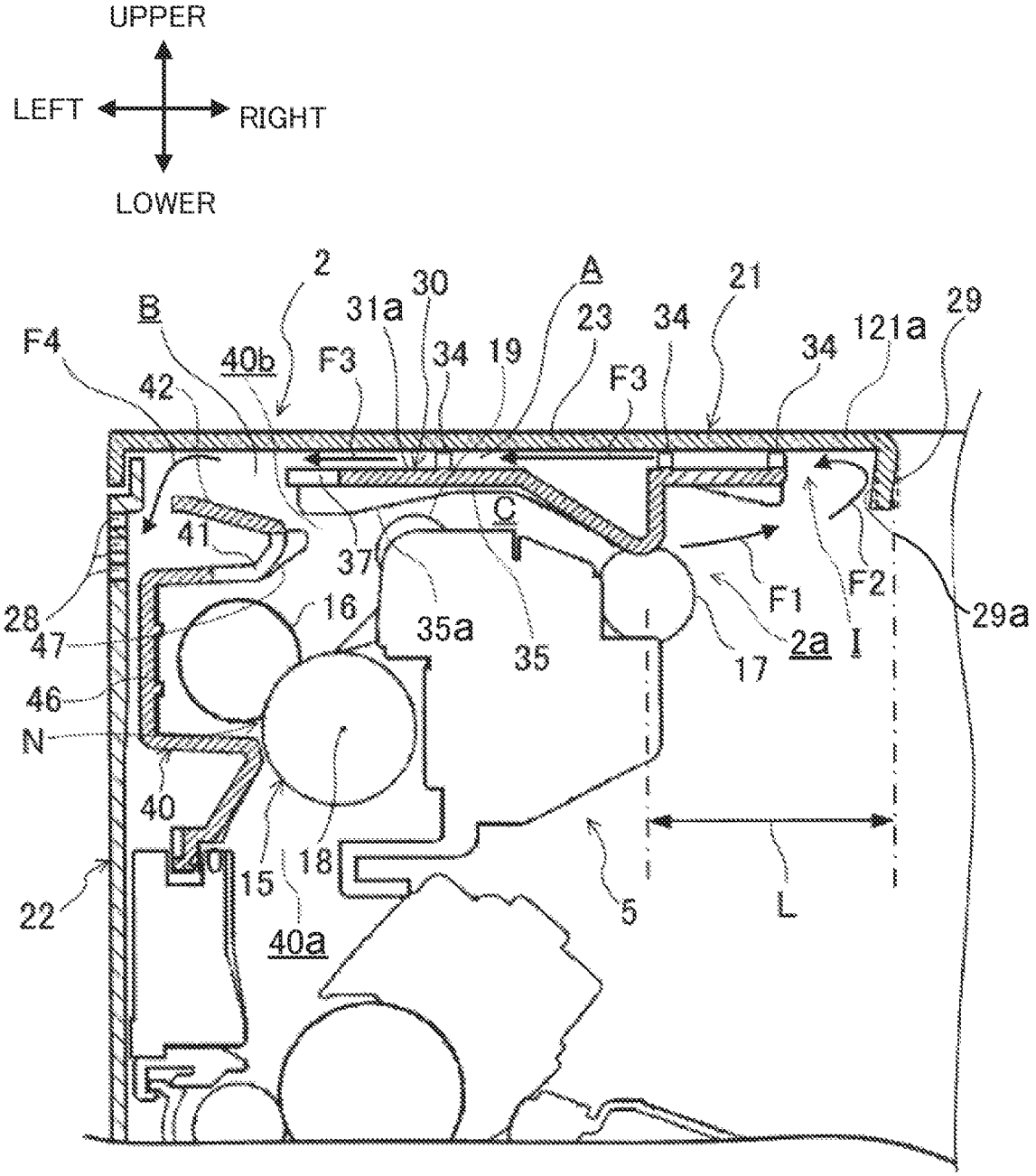
FIG. 10 is a cross-sectional view corresponding to FIG. 3, showing a variation 2.

FIG. 10 illustrates a variation 2 of the embodiment. In this variation, the configuration of the dam member is different from the embodiment.

More specifically, a dam plate 29 (dam member) according to this variation has an air damming surface 29*a* inclined to the upstream side in the sheet transport direction (to the left), in the direction toward the lower side from the right end portion of the upper outer cover 21.

The mentioned configuration allows the air blocked by the dam plate 29 to turn the flow direction at an acute angle, along the air damming surface 29*a* and the lower face of the overhung portion 121*a* of the upper outer cover 21. Therefore, the blocked air can be prevented from leaking to the right side, owing to force of inertia.

Here, the air damming surface 29*a* of the dam plate 29 may extend vertically downward, as indicated by dot lines in FIG. 10. Such a configuration facilitates the punching work in the molding process, and therefore the workability and the guiding performance for the air to the reverse direction can both be attained.

With the configuration according to variation 2, as described above, the air can be assuredly made to flow in the reverse direction by the dam plate 29, thus to be guided to the air passage A. Therefore, the same advantageous effects as those provided by the embodiment can be more assuredly attained.

INDUSTRIAL APPLICABILITY

As described above, the disclosure is advantageously applicable to an image forming apparatus, in particular to a printer, a facsimile machine, a copier, or a multifunction peripheral (MFP).

While the present disclosure has been described in detail with reference to the embodiments thereof, it would be apparent to those skilled in the art the various changes and modifications may be made therein within the scope defined by the appended claims.

What is claimed is:

1. An image forming apparatus comprising:

a fixing device located inside an apparatus main body, including a heating rotating body and a pressure rotating body, and configured to fix a toner image on a sheet, by causing the sheet to pass through a nip region defined between the rotating bodies;

a delivery rotating body that delivers the sheet that has undergone a fixing process by the fixing device, to an outer space on an upper side of the apparatus main body, through a sheet delivery port formed in the apparatus main body;

a guide member including a guide surface that guides the sheet to the delivery rotating body, the guide surface being located so as to oppose one face of the sheet discharged from the fixing device;

an opposing member located so as to oppose the other face of the sheet, and on an opposite side of the guide surface of the guide member, and configured to define an air passage between the opposing member and the guide member, such that one end portion is located on a side of the outer space, and the other end portion, on an opposite side of the outer space, communicates with a predesignated space on a side of the fixing device in the apparatus main body; and a dam member located on an end portion of the outer space of the opposing member, at a position downstream of the delivery rotating body in a sheet transport direction, and configured to dam air about to be discharged together with the sheet by the delivery rotating body, thereby guiding the air into the air passage, from the one end portion of the air passage, wherein a portion of a wall of the apparatus main body adjacent to the predesignated space includes an exhaust port that allows air inside the predesignated space to be discharged to outside.

2. The image forming apparatus according to claim 1, wherein the guide member includes a guide main portion having the guide surface, and an extended portion continuously connected to an end portion of the guide main portion on the downstream side in the sheet transport direction, extending to the downstream side in the sheet transport direction with respect to the delivery rotating body, and defining the one end portion of the air passage between the extended portion and the opposing member, the opposing member includes an overhung portion extending to the downstream side in the sheet transport direction, with respect to the extended portion of the guide member, and the dam member protrudes from the overhung portion toward a delivery route along which the sheet is delivered, and defines an air introduction space communicating with the air passage, between the dam member and a distal end portion of the extended portion of the guide member.

3. The image forming apparatus according to claim 2, wherein the delivery rotating body is configured to deliver the sheet in a horizontal direction, or in a direction inclined upward or downward with respect to the horizontal direction by a predetermined small angle, and the overhung portion covers the delivery route from an upper side, in a region downstream of the delivery rotating body in the sheet transport direction.

4. The image forming apparatus according to claim 1, wherein the fixing device includes a fixing device housing, having a sheet inlet through which the sheet proceeding to the nip region is received, and a sheet outlet through which the sheet that has passed through the nip region is delivered, and accommodating the pressure rotating body and the heating rotating body, and the predesignated space in the apparatus main body is located adjacent to the sheet outlet formed in the fixing device housing, and communicating with a space inside the fixing device housing, via the sheet outlet.

5. The image forming apparatus according to claim 4, wherein a portion of a wall of the apparatus main body adjacent to the predesignated space includes an exhaust port for discharging air inside the predesignated space to outside, and the fixing device housing further includes, in addition to the sheet inlet and the sheet outlet, a communication port that allows communication between inside and outside of the housing, the communication port being opposed to the exhaust port.

6. The image forming apparatus according to claim 5, wherein the air passage communicates with the inside of the fixing device housing, via the sheet outlet, in the predesignated space.

7. The image forming apparatus according to claim 1, wherein the guide member is mounted such that an end portion on an upstream side in the sheet transport direction is located above the fixing device, and the end portion of the guide member on the upstream side in the sheet transport direction includes a plurality of penetrating portions, aligned in a width direction of the transport route, and penetrating through the guide member in an up-down direction.

8. The image forming apparatus according to claim 1, wherein a face of the guide member opposed to the opposing member includes a first protruding portion that secures the air passage between the guide member and the opposing member, by being made to abut against the opposing member.

9. The image forming apparatus according to claim 1, wherein a face of the opposing member opposed to the guide member includes a second protruding portion that secures the air passage between the opposing member and the guide member, by being made to abut against the guide member.

10. The image forming apparatus according to claim 1, wherein an air damming surface of the dam member is inclined to the downstream side in the sheet transport direction, in a direction toward a lower side, from an end portion of the overhung portion on the downstream side in the sheet transport direction.

11. The image forming apparatus according to claim 1, wherein an air damming surface of the dam member extends vertically downward, or is inclined to an upstream side in the sheet transport direction in a direction toward a lower side, from an end portion of the overhung portion on the downstream side in the sheet transport direction.

12. The image forming apparatus according to claim 1, wherein the opposing member constitutes a part of an outer wall of the apparatus main body.

* * * * *